US006801116B2

(12) United States Patent
Oh et al.

(10) Patent No.: US 6,801,116 B2
(45) Date of Patent: Oct. 5, 2004

(54) OVERLOAD PROTECTOR WITH HERMETICALLY SEALING STRUCTURE

(75) Inventors: Yong Kyun Oh, Chungcheongbuk-Do (KR); Yeon Keun Chung, Chungcheongbuk-Do (KR); Young Koo Kim, Chungcheongbuk-Do (KR)

(73) Assignee: Texas Instruments Korea Limited, Chungcheongbuk-Do (KR)

( * ) Notice: Subject to any disclaimer, the term of this patent is extended or adjusted under 35 U.S.C. 154(b) by 0 days.

(21) Appl. No.: 10/464,247

(22) Filed: Jun. 18, 2003

(65) Prior Publication Data

US 2004/0041681 A1 Mar. 4, 2004

(30) Foreign Application Priority Data

Aug. 27, 2002 (KR) ..... 20-2002-0025499

(51) Int. Cl.[7] ..... H01H 37/04
(52) U.S. Cl. ..... 337/112; 337/380
(58) Field of Search ..... 337/36, 85, 112, 337/113, 186, 327, 380, 381, 398, 414; 29/622; 361/673, 679, 728, 730; 312/223.1

(56) References Cited

U.S. PATENT DOCUMENTS 3,430,177 A * 2/1969 Audette ..... 337/365
4,015,229 A * 3/1977 Senor et al. ..... 337/107
4,490,704 A * 12/1984 Snider et al. ..... 337/372
4,636,766 A * 1/1987 Carbone et al. ..... 337/368
4,710,743 A * 12/1987 Givler ..... 337/380
4,860,435 A * 8/1989 Powell ..... 29/622
5,206,622 A * 4/1993 Lattari ..... 337/89
5,337,036 A * 8/1994 Kuczynski ..... 337/343
6,020,807 A * 2/2000 Givler ..... 337/377
6,078,244 A * 6/2000 Quinn et al. ..... 337/140
6,300,858 B1 * 10/2001 Kalapodis et al. ..... 337/140
6,483,418 B1 * 11/2002 Reno et al. ..... 337/379
6,744,345 B2 * 6/2004 Korczynski et al. ..... 337/358

FOREIGN PATENT DOCUMENTS

GB 2110881 A * 6/1983 ..... H01H/37/54

* cited by examiner

*Primary Examiner*—Anatoly Vortman
(74) *Attorney, Agent, or Firm*—Pearne & Gordon LLP

(57) ABSTRACT

Disclosed is an overload protector with a hermetically sealed structure, the overload protector comprising a housing that has an outer peripheral flange and an external connecting terminal and that accommodates a bimetal element having a movable contact and a fixed contact; a conducting plate that is installed to an upper portion of the housing and that has an external connecting terminal and a contact connected to the movable contact of the bimetal element; and an insulating gasket disposed between the housing and the conducting plate, grooves or ribs being formed on the entire flange, and ribs or grooves being formed on a portion of the conducting plate corresponding to the grooves or ribs formed on the flange in such a way that the ribs or grooves of the conducting plate are engaged with the groves or ribs of the flange.

8 Claims, 3 Drawing Sheets

OVERLOAD PROTECTOR WITH HERMETICALLY SEALING STRUCTURE

BACKGROUND OF THE INVENTION

1. Field of the Invention

The present invention relates to an overload protector, and more particularly, to an overload protector with a hermetically sealing structure capable of protecting an insulating solution (e.g., varnish) from permeating into the interior thereof when a winding of a target (e.g., a motor) to which the overload protector is mounted is immersed into an insulating solution to insulate the winding.

2. Description of the Related Art

In general, overload protectors are used in the following: a motor protector for protecting a motor from over-current; a ballast applied with a high voltage to preheat and light a fluorescent lamp, and a transformer for transforming a high voltage to a microwave oven, so as to prevent a target from overload.

Such an overload protector is classified into an internal type and an external type according to the mounting mode thereof. The internal-type overload protector is directly connected a winding of the motor, ballast, or transformer. Since the winding consists of thin and fine wires arranged densely, the winding is generally immersed into an insulating solution such as varnish, so as to place the wiring at a proper position and to insulate the wirings. At that time, since the internal-type overload protector is already built in the target, the overload protector is also immersed in the insulating solution.

The possible permeation of the insulating solution into the overload protector during the immersing process causes the internal circuit of the protector to become inoperable, so that an article with a built-in overload protector may not be protected from overload.

SUMMARY OF THE INVENTION

Accordingly, the present invention is directed to an overload protector that substantially obviates one or more problems due to limitations and disadvantages of the related art.

It is an object of the present invention to provide an overload protector with an improved hermetically sealed structure capable of protecting a foreign substance such as an insulating solution from permeating into the interior thereof.

To achieve these objects and other advantages in accordance with the purpose of the invention as embodied and broadly described herein, an overload protector with a hermetically sealed structure is provided. The overload protector comprises: a housing that has an outer peripheral flange and an external connecting terminal, and that accommodates a bimetal element having a movable contact and a fixed contact; a conducting plate that is installed to an upper portion of the housing, and that has an external connecting terminal and a contact connected to the movable contact of the bimetal element; and an insulating gasket disposed between the housing and the conducting plate, wherein grooves or ribs are formed on the entire flange, and ribs or grooves are formed on a portion of the conducting plate corresponding to the grooves or ribs formed on the flange in such a way that the ribs or grooves of the conducting plate are engaged with the grooves or ribs of the flange.

According to one preferred embodiment of the present invention, the insulating gasket contains a resin, and during the assembly of the overload protector, the resin molten at a thermosetting process is hardened around the grooves or ribs formed at the flange of the housing, thereby improving sealing capability. Preferably, the resin is a polyamide-based resin.

The insulating gasket is formed with a through-hole through which the movable contact of the bimetal element is in contact with the contact of the conducting plate.

The insulating gasket includes bending portions formed in a longitudinal direction thereof for fixing the conducting plate during the assembly step of the overload protector.

The housing includes bending portions formed in a longitudinal direction thereof for fixing the gasket and the conducting plate during the assembly step of the overload protector.

The housing includes two protruded contacts each making contact with the movable and fixed contacts of the bimetal element.

The overload protector of the present invention may be used in an electric appliance, which generates heat at activation, such as a motor, a ballast for a fluorescent lamp, a transformer, and so forth.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a pail of this application, illustrate embodiment(s) of the invention and together with the description serve to explain the principle of the invention. In the drawings.

DETAILED DESCRIPTION OF THE PREFERRED EMBODIMENT

Figure 1:
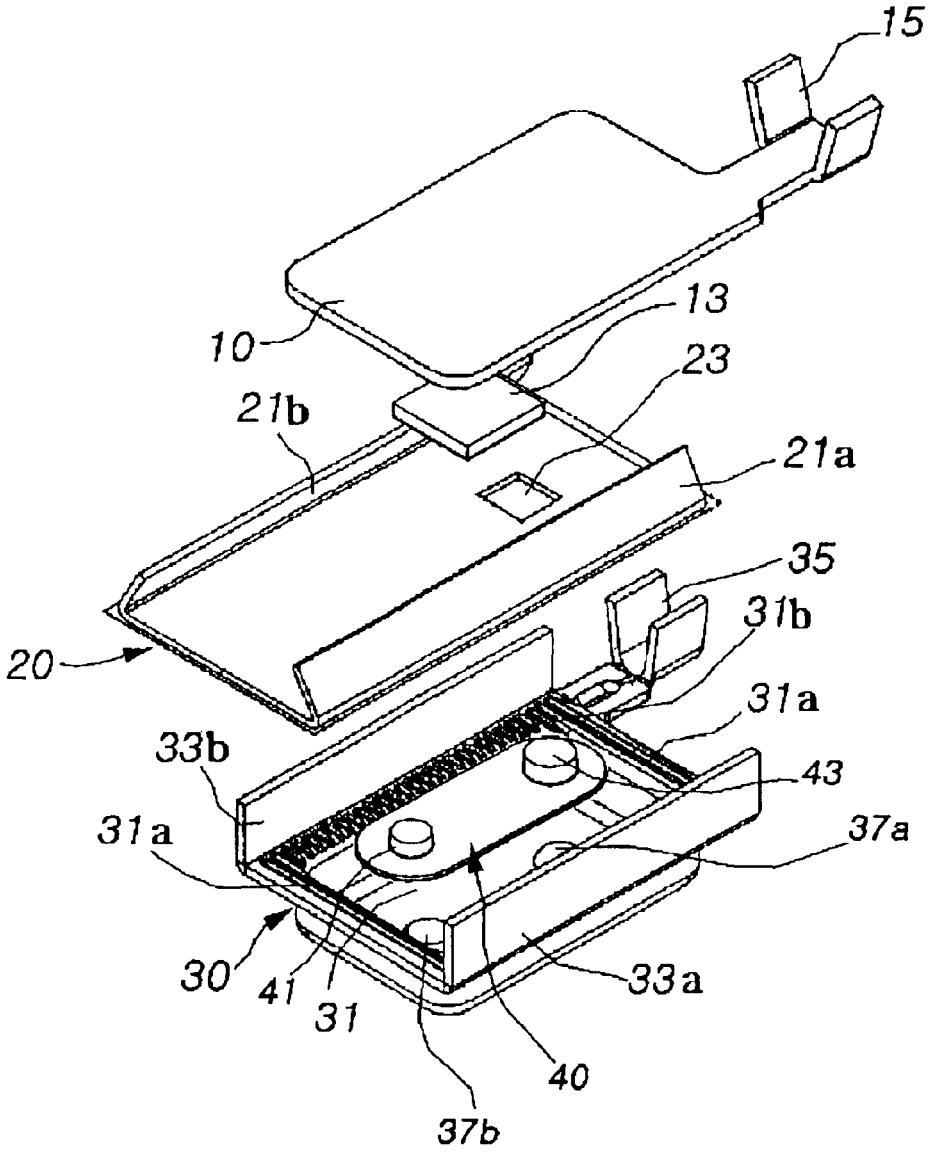
FIG. 1 is an exploded perspective view of the top of an overload protector according to the present invention.

Reference will now be made in detail to the preferred embodiment of the present invention, an example of which is illustrated in the accompanying drawings. It is noted that like parts are shown by corresponding reference numerals throughout the drawings.

Figure 2:
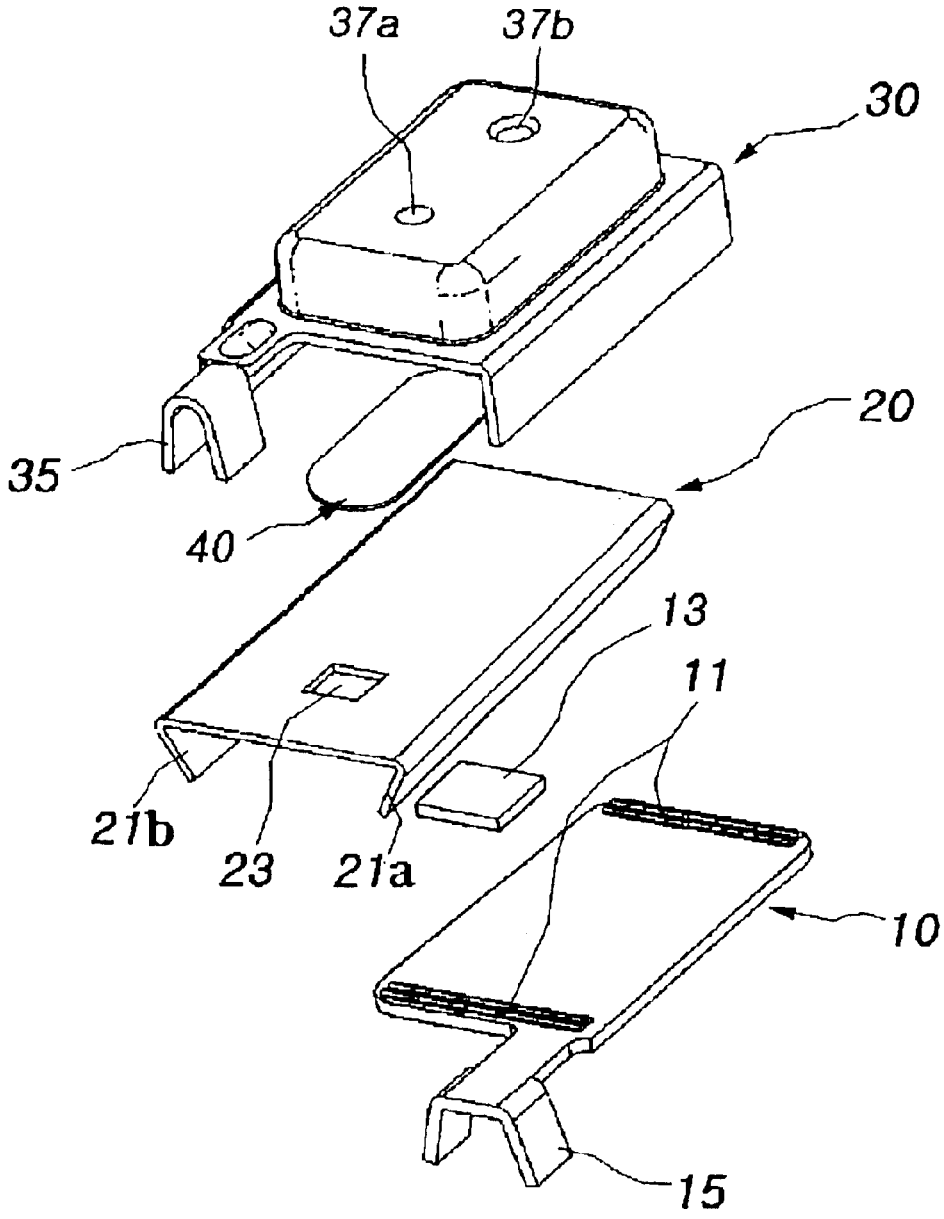
FIG. 2 is an exploded perspective view of the bottom of an overload protector according to the present invention.

FIGS. 1 and 2 are exploded perspective views of an overload protector according to the present invention, in which FIG. 1 is a top view of the overload protector, and FIG. 2 is a bottom view of the overload protector.

Figure 3:
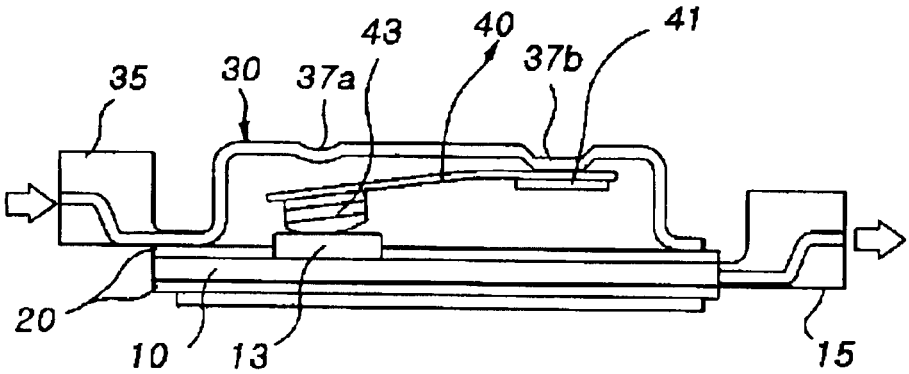
FIG. 3 is a view showing the operation of an overload protector according to the present invention.
Figure 3:
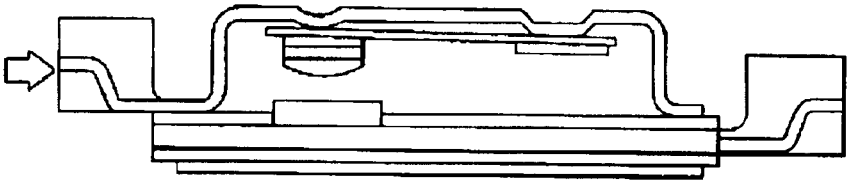

FIG. 3 shows the operation of the overload protector according to the present invention.

The overload protector with a hermetically sealed structure according to the present invention includes a housing 30 that has an external connecting terminal 35 and that accommodates a bimetal element 40; a conducting plate 10 that has an external connecting terminal 15 and that is electrically connected to the housing through the bimetal element; and an insulating gasket 20 disposed between the housing and the conducting plate for insulation.

The housing 30 includes a body 31 accommodating the bimetal element 40, and a flange formed along the body. The flange is formed at both longitudinal sides thereof with assembling bending portions 33*a* and 33*b* for fixing the insulating gasket 20 and the conducting plate 10 when assembling the overload protector.

Also, the flange of the housing 30 is provided on a surface thereof with grooves or ribs 31*a* and 31*b*. The conducting plate 10 is provided on a surface thereof corresponding to the surface of the flange with ribs or grooves 11 in such a way that the ribs or grooves 11 are engaged with the grooves or ribs 31*a* and 31*b*. With the structure as mentioned above, when the insulating gasket is carried out through a thermosetting process, a resin such as polyamide-based resin contained in the insulating gasket is molten. The molten resin is hardened around the grooves or ribs 31*a* and 31*b* formed at the flange of the housing 30, thereby improving the sealing capability.

The bimetal element 40 includes a fixed contact 41 secured to the housing 30, and a movable contact 43 capable of being selectively connected to a contact 13 of the conducting plate 10 through the gasket 20.

The body 31 of the housing 30 has, one protruded contacting portion 37*b* contacted to the bimetal element 40. The other protruded contacting portion 37*a* is selectively contacted to the bimetal element 40.

The insulating gasket 20 is a flat plate with a through-hole 23, and has fixing bending portions 21*a* and 21*b* for fixing the conducting plate 10 in a longitudinal direction thereof. The through-hole 23 may be used as a passage for electrically connecting the housing and the conducting plate through the movable contact 43 of the bimetal element at the insulating gasket 20, which insulates the housing and the conducting plate.

The conducting plate 10 is substantially rectangular and flat, and is provided at one portion protruding from one side thereof with an external contact terminal 15 for electrically connecting the plate to the external.

It does not matter where the external connecting terminals 15 and 35 of the conducting plate and housing are positioned as long as the position does not correspond to each other.

The operation of the overload protector according to the present invention will now be described with reference to FIG. 3.

FIG. 3*a* shows the non-operational state of the overload protector of the present invention, i.e., the overload protector operates at a normal operating condition without applying overload thereto. FIG. 3*b* shows the state that the overload protector of the present invention detects overload and then cuts off the circuit.

Since the conducting plate is flat and the respective external contacting terminals of the conducting plate and the housing do not overlap with each other, the plate is assembled in any direction relative to the housing. In order to more clearly illustrate the operating state of the overload protector, the assembled direction of the conducting plate is contrary to that shown in FIGS. 1 and 2.

In case of normal operation of the overload protector, the current applied from the external contacting terminal 35 flows along the housing 30 made of conductive material. The current then flows from the fixed contact 41 of the bimetal element 40 secured to the protruded contact 37*b* of the housing to the movable contact 43. After that, the current flows to the external contacting terminal 15 through the conducting plate 10 connected to the movable contact by the contact 13, so that the housing and the conducting plate are electrically connected to each other.

In the case of applying an overload to the protector, the bimetal element 40 connected to the contact 13 carries out the bimetal action due to the resistance of over-current, such that the movable contact 43 is in contact with the protruded contact 37*a* of the housing to interrupt the electrical connection between the housing and the conducting plate, thereby protecting the article with built-in overload protector from overload.

The overload protector according to the present invention may be applied to the electrical appliance, which generates heat at activation, such as a motor, a ballast for a fluorescent lamp, a transformer, and so forth.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An overload protector with a hermetically sealed structure, the overload protector comprising:

a housing that has an outer peripheral flange and an external connecting terminal, and that accommodates a bimetal element having a movable contact and a fixed contact;

a conducting plate that is installed to an upper portion of the housing, and that has an external connecting terminal and a contact connected to the movable contact of the bimetal element; and an insulating gasket disposed between the housing and the conducting plate, wherein grooves or ribs are formed on the entire outer peripheral flange, and ribs or grooves are formed on a portion of the conducting plate corresponding to the grooves or ribs formed on the flange in such a way that the ribs or grooves of the conducting plate are engaged with the grooves or ribs of the flange.

2. The overload protector as claimed in claim 1, wherein the insulating gasket contains a resin, and during the assembly of the overload protector, the resin molten at a thermosetting process is hardened around the grooves or ribs formed at the flange of the housing, thereby improving sealing capability.

3. The overload protector as claimed in claim 2, wherein the resin is a polyamide-based resin.

4. The overload protector as claimed in claim 1, wherein the insulating gasket is formed with a through-hole through which the movable contact of the bimetal element is in contact with the contact of the conducting plate.

5. The overload protector as claimed in claim 1, wherein the insulating gasket includes bending portions formed in a longitudinal direction thereof for fixing the conducting plate during the assembly step of the overload protector.

6. The overload protector as claimed in claim 1, wherein the housing includes bending portions formed in a longitudinal direction thereof for fixing the gasket and the conducting plate during the assembly step of the overload protector.

7. The overload protector as claimed in claim 1, wherein the housing includes two protruded contacts each making contact with the movable and fixed contacts of the bimetal element.

8. The overload protector as claimed in claim 1, wherein the overload protector is used in an electrical appliance, which generates heat at activation, such as a motor, a ballast for a fluorescent lamp, a transformer, and so forth.

* * * * *